US005298004A

United States Patent [19]

Davis

[11] Patent Number: 5,298,004

[45] Date of Patent: Mar. 29, 1994

[54] EXERCISE APPARATUS

[76] Inventor: Chris L. Davis, P.O. Box 388, Edgewood, Tex. 75117

[21] Appl. No.: 913,226

[22] Filed: Jul. 14, 1992

[51] Int. Cl.[5] ..... A63B 21/062

[52] U.S. Cl. ..... 482/99; 482/98; 482/102; 482/103

[58] Field of Search ..... 482/94–103, 482/133–139

[56] References Cited

U.S. PATENT DOCUMENTS

| | | | |
|---|---|---|---|
| 3,301,552 | 1/1967 | Ryan | 482/102 |
| 3,717,342 | 2/1973 | Haney et al. | 482/102 X |
| 3,807,728 | 4/1974 | Chillier | 482/101 |
| 3,840,227 | 10/1974 | Chesemore | 482/102 |
| 3,966,203 | 6/1976 | Bickford | 482/103 |
| 4,591,149 | 5/1986 | Godfrey | 482/99 X |
| 4,625,959 | 12/1986 | Schleffendorf | 482/100 |
| 4,753,437 | 6/1988 | Lapcevic | 482/99 X |

*Primary Examiner*—Robert Bahr
*Attorney, Agent, or Firm*—W. Kirk McCord

[57] ABSTRACT

A physical exercise/therapy apparatus includes a generally upstanding frame with a plurality of support bars at the top of the frame. The support bars are adapted to support a plurality of exercise pulleys, whereby a plurality of exercise devices are provided. The respective positions of the pulleys are adjustable to accommodate a wide variety of different types of muscle exercises. The frame includes a plurality of stall bars adapted to support a relatively flat board in an inclined position and a plurality of support rods spaced vertically along each side of the frame for supporting a stacking board. A guide mechanism is provided for guiding the movement of an exercise weight, such that the weight is constrained to move along a vertical axis. The guide mechanism includes inner and outer hollow members and a plate member attached to the inner hollow member. The plate member is configured to ride up and down within a vertically oriented slot in the outer hollow member to constrain the weight to move up and down along a vertical axis parallel to the slot.

4 Claims, 3 Drawing Sheets

EXERCISE APPARATUS

FIELD OF INVENTION

This invention relates generally to physical exercise apparatus and in particular to a physical exercise apparatus combining a plurality of different physical exercise devices in a compact unit.

BACKGROUND OF THE INVENTION

Apparatus for exercising various muscle groups are known in the art. Typically, each apparatus is specially designed for a particular muscle exercise. In order to perform a wide variety of muscle exercises, multiple apparatus are typically required.

In addition to use in connection with body building and muscle toning exercises, exercise apparatus are also used in physical therapy to help a person recover from a physical injury. Physical therapy clinics usually no not have sufficient space to accommodate a large number of exercise apparatus. There is therefore a need for an exercise apparatus which can accommodate a wide variety of muscle exercises in a relatively compact unit.

DISCLOSURE OF THE INVENTION

In accordance with present invention, an exercise apparatus is provided having a generally upright frame adapted to accommodate various types of physical exercise devices in a compact unit. In accordance with a unique feature of the invention, the apparatus includes moveable weight means supported by the frame for vertical lifting, flexible cable means attached at one end thereof to the weight means, pulley means supported by the frame for supporting the cable means, and handle means attached to an opposite end of the cable means from the weight means, whereby the weight means is moveable by a force applied by a person grasping the handle means. The apparatus further includes a plurality of stall bars spaced vertically along the frame. Each of the stall bars is adapted to support a relatively flat board in an inclined position. The angle of inclination of the board is determined by the height of the particular stall bar supporting the board. The apparatus further includes a plurality of first support rods spaced vertically along one side of the frame and a plurality of second support rods spaced vertically along an opposite side of the frame from the first support rods. Each of the first support rods cooperates with a corresponding one of the second support rods to support a shelf in a substantially horizontal position. The height of the shelf is determined by the particular ones of the first and second support rods supporting the shelf.

In accordance with another unique feature of the invention, the pulley means includes a plurality of pulleys. Mounting means is provided for mounting at least one of the pulleys at a plurality of discrete positions spaced vertically along the frame, whereby the angle of the cable means is adjustable relative to a vertical axis. In one embodiment, the pulley mans includes first, second and third pulleys. The first pulley is laterally spaced from the second pulley and the third pulley is positioned below the first and second pulleys for changing the direction of the cable means. The second pulley is positioned between the first pulley and the weight means and the third pulley is positioned between the first pulley and the handle means. The mounting means is adapted to mount the third pulley at a plurality of discrete positions spaced vertically along the frame for adjusting the angle of a portion of the cable means between the first and third pulleys, relative to a vertical axis.

In another embodiment, the weight means includes first and second moveable weights, the cable means includes first and second flexible cables, the handle means includes first and second handles, and the pulley means includes first, second, third, fourth, fifth and sixth pulleys. The first, second and third pulleys cooperate to support the first cable with the first weight attached at one end thereof and the first handle attached at an opposite end thereof from the first weight to provide a first exercise device on one side of the frame. The first pulley is laterally spaced from the second pulley and the third pulley is positioned below the first and second pulleys for changing the direction of the first cable. The second pulley is positioned between the first weight and the first pulley. The third pulley is positioned between the first pulley and the first handle. The third pulley is positionable at a plurality of discrete positions spaced vertically along the frame for adjusting the angle of a portion of the first cable between the first and third pulleys, relative to a vertical axis. The fourth, fifth and sixth pulleys cooperate to support the second cable with the second weight attached at one end thereof and the second handle attached at an opposite end thereof from the second weight to provide a second exercise device on an opposite side of the frame from the first exercise device. The fourth pulley is laterally spaced from the fifth pulley and the sixth pulley is positioned below the fourth and fifth pulleys for changing the direction of the second cable. The fifth pulley is positioned between second weight and the fourth pulley and the sixth pulley is positioned between the fourth pulley and the second handle. The sixth pulley is positionable at a plurality of discrete positions spaced vertically along the frame for adjusting the angle of a portion of the second cable between the fourth and sixth pulleys, relative to a vertical axis.

In accordance with yet another unique feature of the invention, the apparatus includes guide means for guiding the cable means to move the weight means substantially along a vertical axis. The guide means is comprised of a first hollow member attached to the frame, a second hollow member received within the first hollow member and a projecting member projecting from the second hollow member. The first hollow member includes a slot. The projecting member is in mating engagement with the slot. Moveable weight means is carried on the projecting member outside the first hollow member. The second hollow member is moveable within the first hollow member and the projecting member is moveable within the slot by a force applied by a person grasping the handle means. The weight means is constrained to move along a vertical axis parallel to the slot on the outside of the first hollow member by the movement of the projecting member within the slot. The projecting member includes at least one opening, whereby the flexible cable means is attached to the projecting member with one end of the cable means being passed through the projecting member opening.

In one embodiment, the projecting member includes first and second vertically spaced openings. The first opening is adapted to accommodate the passage of the one end of the cable means therethrough in a first direction. The second opening is adapted to accommodate the passage of the one end of the cable means therethrough in a second direction, opposite from the first direction, whereby a portion of the cable means is retained in facing contact with the projecting member between the first and second openings. The position of the projecting member along the cable means is adjustable to adjust the height of the weight means accordingly. In the preferred embodiment, the first and second hollow members are substantially cylindrical and the projecting member is a relatively flat plate member projecting radially outward from an outer surface of the second hollow member into and through the slot.

DETAILED DESCRIPTION OF THE PREFERRED EMBODIMENT

Figure 1:
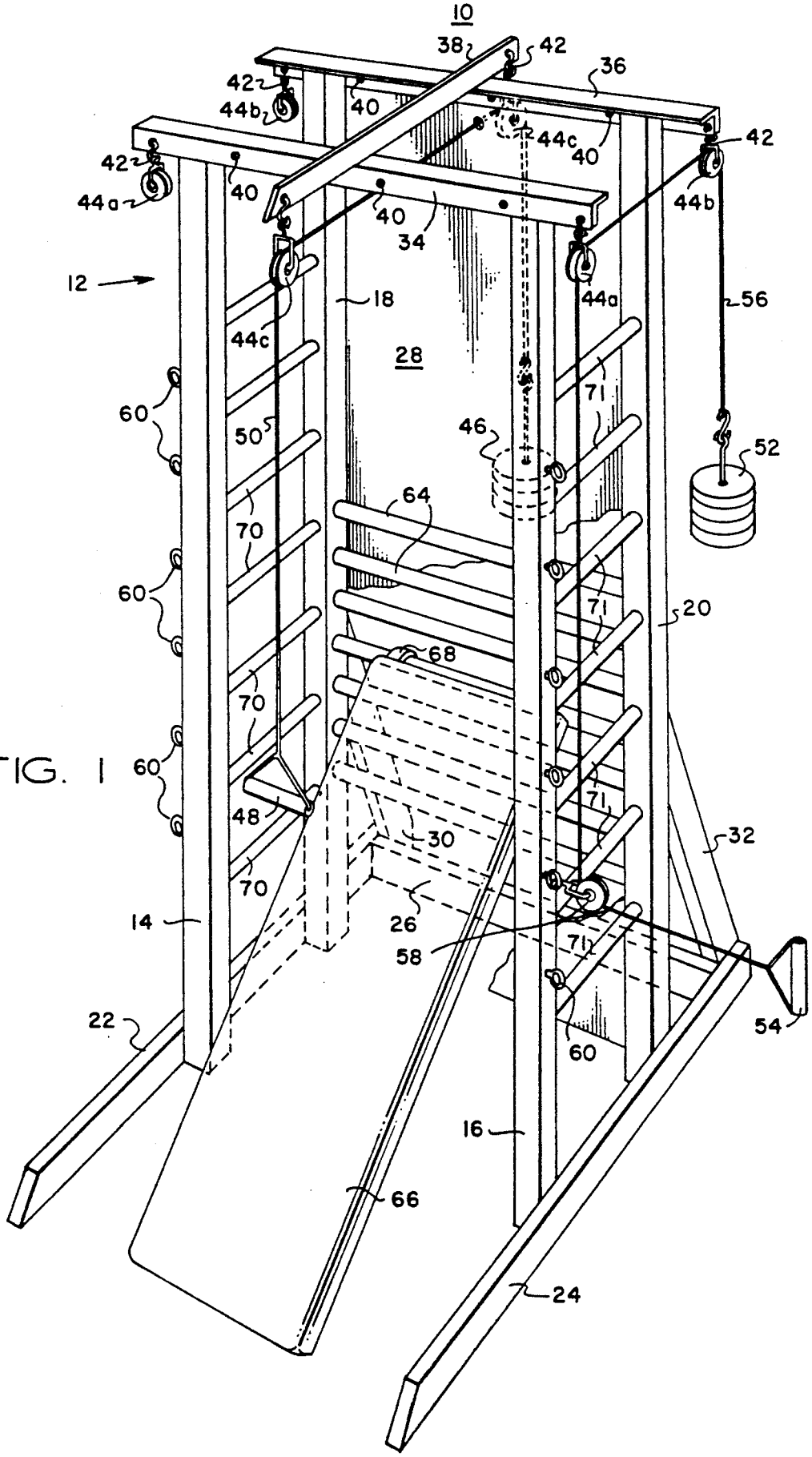
FIG. 1 is a perspective view of a physical exercise apparatus, according to the present invention.

In the description which follows, like parts are marked throughout the specification and drawings with the same respective reference numerals. The drawings are not necessarily to scale and in some instances proportions may have been exaggerated in order to more clearly depict certain features of the invention.

Figure 2:
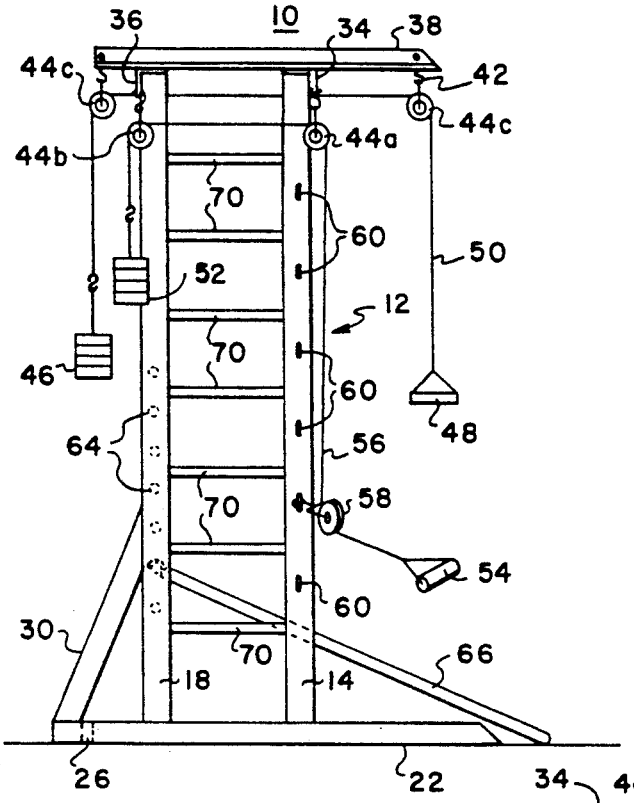
FIG. 2 is a side elevation view of the exercise apparatus of FIG. 1.

Referring to FIGS. 1 and 2, an exercise apparatus 10 according to the present invention is comprised of a generally upstanding frame 12, which is defined by two front uprights 14 and 16, two rear uprights 18 and 20, and three base support beams 22, 24 and 26. Base support beams 22 and 24 are parallel and base support beam 26 extends transversely between parallel base support beams 22 and 24. Frame 12 further includes a back panel 28, which is secured to respective back faces of rear uprights 18 and 20, and two bracing members 30 and 32, which are coupled between base support beam 26 and back panel 28. Frame 12 is preferably made of a lightweight wood material. Alternatively, frame 12 can be made of other types of material, such as particle board, plastic or other lightweight synthetic material.

Three support bars 34, 36 and 38 are attached to the top of frame 12. Support bars 34, 36 and 38 are preferably steel angle irons. Front support bar 34 is attached to respective top portions of front uprights 14 and 16 and spans between front uprights 14 and 16, with respective end portions of front support bar 34 extending beyond front uprights 14 and 16 on respective opposed sides of frame 12. Rear support bar 36 is attached to respective top portions of rear uprights 18 and 20 and spans between rear uprights 18 and 20, with respective end portions of rear support bar 36 extending beyond rear uprights 18 and 20 on respective opposed sides of frame 12. Front and rear support bars 34 and 36 are in parallel relationship. Support bar 38 is secured to front and rear support bars 34 and 36 and extends transversely across support bars 34 and 36.

Front and rear support bars 34 and 36 each have a plurality of holes 40 at spaced intervals along the respective support bars 34 and 36. Each hole 40 is adapted to receive a hooked portion of a hanger device 42, whereby a corresponding pulley 44 is supported. Two pulleys 44*a* are shown suspended from respective opposed ends of front support bar 34 and two pulleys 44*b* are shown suspended from respective opposed ends of rear support bar 36. The position of each pulley 44*a*, 44*b* is particular hole 40 corresponding t the desired pulley position. Support bar 38 has holes (not shown) at respective opposed ends thereof for receiving respective hanger devices 42 to suspend respective pulleys 44*c*, as shown in FIG. 1. Each pulley 44*a*, 44*b*, 44*c* is preferably a swivel pulley having a diameter of approximately three inches.

The two pulleys 44*c* suspended from support bar 38 support a moveable weight 46 and a handle 48, which are tethered by means of a flexible cable, such as a ¾ inch rope 50. Handle 48 is adapted to be grasped by a person, whereby a force exerted by the person grasping handle 48 moves weight 46 in a generally vertical direction. Each of the pulleys 44*a* cooperates with an adjacent pulley 44*b* to support a moveable weight 52 and a handle 54, which are tethered by means of a flexible cable, such as a ¾ inch rope 56. Each handle 54 is also adapted to be grasped by a person, whereby a force exerted by the person moves the corresponding weight 52 in a generally vertical direction. A doubling pulley 58 having a diameter of approximately two inches is coupled to each of the front uprights 14, 16 for changing the direction of the corresponding rope 56. Respective outwardly facing surfaces of front uprights 14 and 16 have a plurality of eye bolts 60 spaced therealong. Each eye bolt 60 is adapted to receive a hanger device 42 for suspending a corresponding doubling pulley 58 from the corresponding front upright 14, 16, as can be best seen in FIG. 2. By changing the position of the corresponding pulley 58 along the length of the corresponding front upright 14, 16, the angle of the corresponding rope 56 is adjusted relative to a vertical axis to vary the muscle exercise as desired. One cooperating set of pulleys 44*a*, 44*b* and 58, together with the corresponding weight 52, handle 54 and rope 56, provides a first exercise device on one side of frame 12. The other cooperating set of pulleys 44*a*, 44*b* and 58, together with the corresponding weight 52, handle 54 and rope 56, provides a second exercise device on an opposite side of frame 12 from the first exercise device. Pulleys 44*c*, together with weight 46, handle 48 and rope 50, provide yet a third exercise device, intermediate the first and second exercise devices.

In an alternate embodiment (not shown), two pulleys 44*a* are positionable proximate to each end of front support bar 34 and two pulleys 44*b* are positionable adjacent each end of rear support bar 36. The two pulleys 44*a* proximate to each end of front support bar 34 cooperate to provide a discrete exercise device, such that the four pulleys 44*a* provide first and second exercise devices on respective opposed sides of frame 12. The two pulleys 44*b* proximate to each end of rear support bar 36 cooperate to provide a discrete exercise device, such that the four pulleys 44*b* provide third and fourth exercise devices on respective opposed sides of frame 12. The holes 40 in each support bar 34, 36 allow a plurality of pulleys 44*a*, 44*b* to be suspended from the corresponding support bar 34, 36.

Frame 12 further includes a plurality of wooden stall bars 64 extending between rear uprights 18 and 20. Respective opposed ends of each stall bar 64 are received in complementary openings in the corresponding rear uprights 18 and 20. Stall bars 64 are in substantially parallel relationship at spaced intervals along the height of frame 12. Stall bars 64 are adapted to support a relatively flat board 66 in an inclined position. One end of board 66 has a pair of hooks 68, which are adapted to fit over a corresponding stall bar 64, to support board 66 in an inclined position. The angle of incline of board 66 is adjustable by positioning hooks 68 in overlapping relationship with a particular one of the stall bars 64. The higher the stall bar 64 which supports board 66, the greater the angle of inclination of board 66.

Frame 12 further includes a plurality of first wooden support rods 70 extending between front and rear uprights 14 and 18 and a plurality of second wooden support rods 71 extending between front and rear uprights 16 and 20. Respective opposed ends of each support rod 70 are received within complementary openings in front and rear uprights 14 and 18. Respective opposed ends of each support rod 71 are receiving within complementary openings in front and rear uprights 16 and 20. Rods 70 are in substantially parallel relationship at spaced intervals along the height of frame 12 on one side thereof. Rods 71 are in substantially parallel relationship at spaced intervals along the height of frame 12 on an opposite side thereof from rods 70. As can be best seen in FIG. 1, each rod 70 is adapted to cooperate with a corresponding rod 71 for supporting a relatively flat shelf 72. Shelf 72 is positionable at different heights, depending upon which cooperating pair of rods 70, 71 is used to support board 72.

Figure 3:
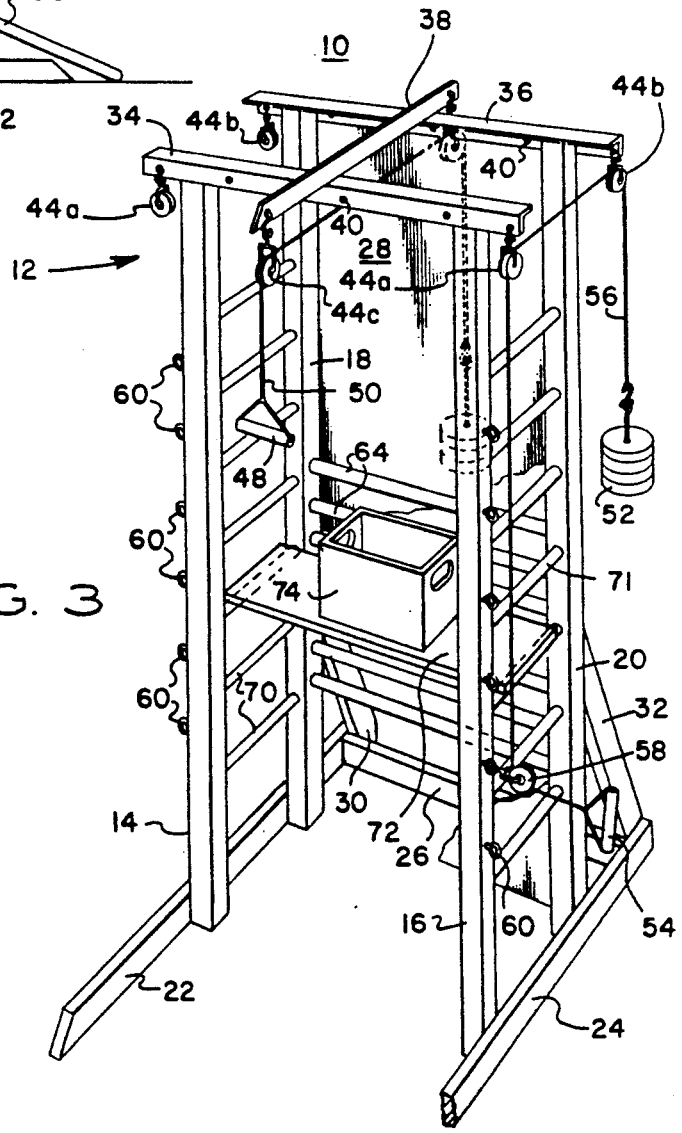
FIG. 3 is a perspective view illustrating the use of the apparatus of FIG. 1 with a stacking board.
Figure 4:
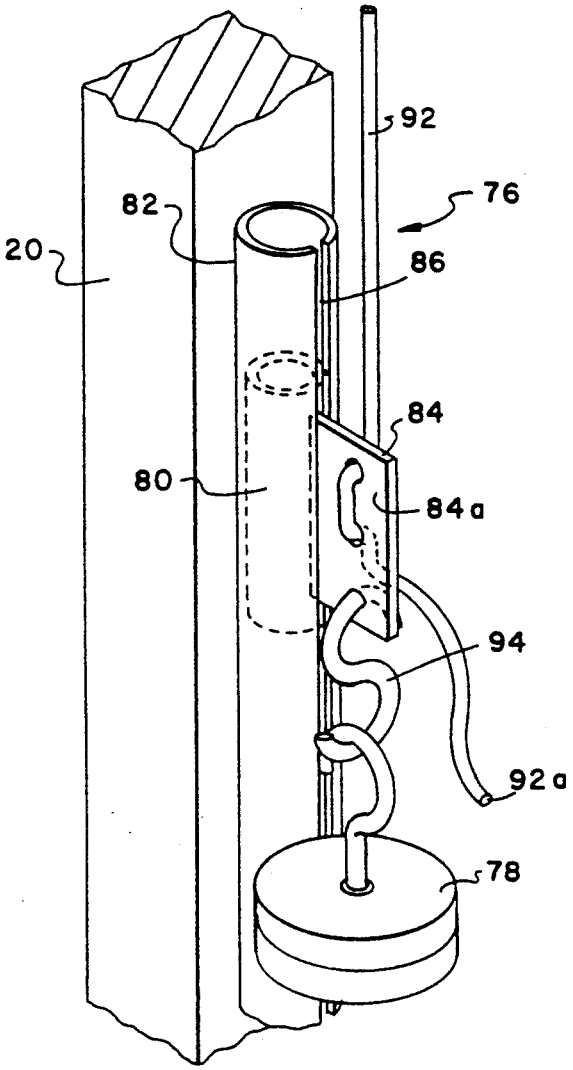
FIG. 4 is a detailed perspective view of a guide mechanism incorporated into the exercise apparatus of FIG. 1.
Figure 5A:
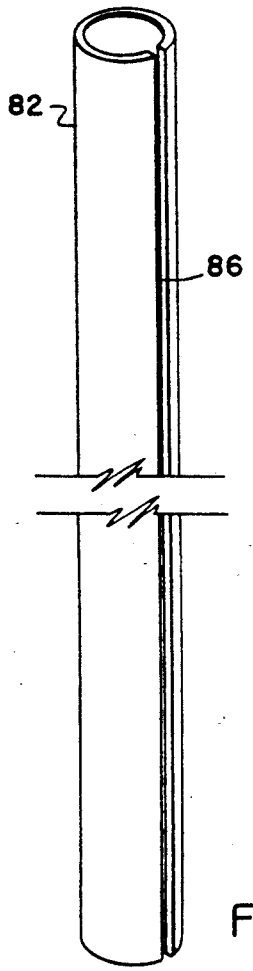
FIGS. 5A–5C are respective elevational views of the major components of the guide mechanism of FIG. 4.
Figure 5B:
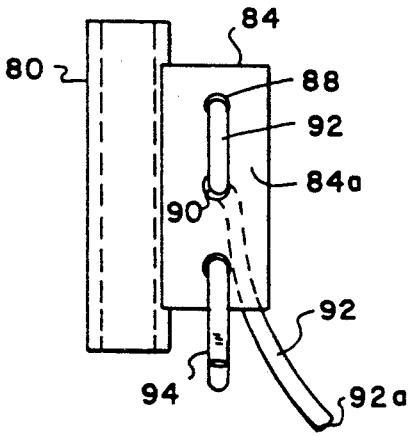
Figure 5C:
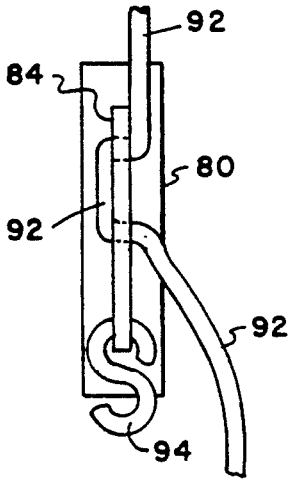

Referring also to FIG. 3, exercise apparatus 10 is able to accommodate a wide variety of muscle exercises in a relatively compact unit. The exercises include arm muscle exercises for manipulating a selected one or more of the weights 46, 52, and body limbering exercises on inclined board 66. Shelf 72 can be used for lifting exercises, whereby a user lifts a relatively light weight, such as the box 74 shown in FIG. 3, up and down onto and off of shelf 72. Apparatus 10 can be conveniently used for physical exercise/therapy by a plurality of persons simultaneously.

Referring now to FIGS. 4 and 5A-5C, apparatus 10 includes a guide mechanism 76 for guiding the movement of a weight 78 in a substantially vertical direction. Guide mechanism 76 includes inner and outer hollow members 80 and 82, respectively, and a relatively flat plate member 84 projecting radially outward from an outer surface of inner tubular member 80. Outer hollow member 82 includes an elongated slot 86, extending substantially the entire length of outer hollow member 82. Inner hollow member 80 is positionable within outer hollow member 82, with plate member 84 in mating engagement with slot 86, such that plate member 84 is constrained to ride up and down within slot 86. Hollow members 80 and 82 are preferably cylindrically-shaped tubular members.

Plate member 84 includes a pair of openings 88 and 90 through which a flexible cable, such as a rope 92, is passed. Rope 92 passes through opening 88, downwardly along a major surface 84*a* of plate member 84 and back through opening 90, as can be best seen in FIG. 5C. Plate member 84 further includes a hanger member 94, which is adapted to support weight 78. The starting height of weight 78 is adjustable by adjusting the position of inner hollow member 80 and plate member 84 along rope 92, whereby the length of rope 92 between opening 90 and free end 92*a* of rope 92 is concomitantly adjusted.

The position of inner hollow member 80 and plate member 84 is adjusted along rope 92 by pulling free end 92*a* back through opening 90 and then sliding inner hollow member 80 and plate member 84 either upward or downward, as the case may be, along rope 92 until weight 78 is at the desired height. Free end 92*a* is then passed back through opening 90 to maintain weight 78 at the desired height. Plate member 84 provides a quick and convenient mechanism for adjusting the base position of weight 78. The base position corresponds to the starting height of weight 78.

Outer hollow member 82 is preferably attached to one of the rear uprights 18, 20 with slot 86 oriented along a vertical axis. Hollow member 82 preferably extends substantially the entire length of the corresponding rear upright 18, 20 for maximum travel of weight 78. Inner hollow member 80 is moveable within outer hollow member 82 and plate member 84 is constrained to move within slot 86 by the mating engagement between plate member 84 and slot 86, whereby weight 78 is constrained to move up and down along a vertical axis on the outside of outer hollow member 82. Frame 12 can be configured with a plurality of guide mechanisms, with a hollow member 82 attached to each of the rear uprights 18, 20.

The exercise apparatus according to the present invention provides multiple exercise stations which can be used simultaneously by different persons for different types of muscle exercises. The apparatus is adapted for various types of physical exercises, including body-building, muscle toning and body limbering exercises, as well as physical therapy and rehabilitation. Because of the compact size of the apparatus, the apparatus is particularly well-suited for use in physical therapy clinics, where space is often at a premium.

The preferred embodiment of the invention has now been described in detail. Since it is obvious that many changes in and additions to the above-described preferred embodiment may be made without departing from the nature, spirit and scope of the invention, the invention is not to be limited to the disclosed details, except as set forth in the appended claims.

What is claimed is:

1. An exercise apparatus comprising, in combination:

a generally upstanding frame;

moveable weight means supported by said frame for vertical lifting;

flexible cable means;

pulley means supported by said frame for receiving said cable means;

handle means attached to one end of said cable means, whereby said weight means is moveable by a force applied by a person grasping said handle means; and guide means for guiding said cable means to move said weight means substantially along a vertical axis, said guide means comprising:

a first hollow member attached to said frame, said first hollow member having a slot;

a second hollow member received within said first hollow member;

a projecting member projecting from said second hollow member into said slot, such that said projecting member is in mating engagement with said slot, said cable means being attached to said projecting member, said weight means being carried on said projecting member, said weight means being constrained to move along an axis parallel to said slot with the movement of said projecting member within said slot.

2. Apparatus of claim 1 wherein said projecting member has at least one opening therein, said cable means being attached to said projecting member with an end thereof opposite from said one end being passed through said at least one opening.

3. Apparatus of claim 2 wherein said at least one opening includes first and second vertically spaced openings, said first opening being adapted to accommodate the passage of said opposite end of said cable means therethrough in a first direction, said second opening being adapted to accommodate the passage of said opposite end of said cable means therethrough in a second direction opposite from said first direction, whereby a portion of said cable means is retained in facing contact with said projecting member between said first and second openings, the position of said projecting member along said cable means being adjustable to adjust the height of said weight means accordingly.

4. Apparatus of claim 3 wherein said projecting member is a relatively flat plate member and said first and second hollow members are substantially cylindrical, said plate member projecting radially outward from an outer surface of said second hollow member into and through said slot.

* * * * *